US007814831B2

(12) United States Patent
Wientjens et al.

(10) Patent No.: US 7,814,831 B2
(45) **Date of Patent: *Oct. 19, 2010**

(54) PRINTING MODULE, AND PRINTING MACHINE PROVIDED WITH SUCH PRINTING MODULE

(75) Inventors: Hendrikus Theodorus Wientjens, Leuth (NL); Lambert Dirk van den Brink, St. Agatha (NL)

(73) Assignee: MPS Holding B.V., Didam (NL)

( * ) Notice: Subject to any disclaimer, the term of this patent is extended or adjusted under 35 U.S.C. 154(b) by 1019 days.

This patent is subject to a terminal disclaimer.

(21) Appl. No.: 10/537,098

(22) PCT Filed: Dec. 2, 2003

(86) PCT No.: PCT/NL03/00849

§ 371 (c)(1),
(2), (4) Date: Dec. 29, 2005

(87) PCT Pub. No.: WO2004/050366

PCT Pub. Date: Jun. 17, 2004

(65) Prior Publication Data

US 2006/0117971 A1 Jun. 8, 2006

(30) Foreign Application Priority Data

Dec. 2, 2002 (NL) ..... 1022049

(51) Int. Cl.
*B41F 1/34* (2006.01)
*B41F 5/04* (2006.01)

(52) U.S. Cl. ..... 101/480; 101/219; 101/479

(58) Field of Classification Search ..... 101/216, 101/219, 479, 480
See application file for complete search history.

(56) References Cited

U.S. PATENT DOCUMENTS

| | | | | |
|---|---|---|---|---|
| 4,567,827 | A * | 2/1986 | Fadner | 101/352.11 |
| 4,572,069 | A * | 2/1986 | Schwarzbeck | 101/76 |
| 4,878,427 | A * | 11/1989 | Washchynsky et al. | 101/219 |
| 5,277,112 | A * | 1/1994 | Ohta et al. | 101/425 |
| 6,318,257 | B1 * | 11/2001 | Niemiro et al. | 101/212 |
| 6,718,876 | B1 * | 4/2004 | Williamsson | 101/479 |
| 6,941,861 | B2 * | 9/2005 | Bitterich et al. | 101/216 |
| 2006/0117972 | A1 * | 6/2006 | van de Bovenkamp | 101/216 |
| 2008/0229958 | A1 * | 9/2008 | Catelli | 101/479 |

* cited by examiner

*Primary Examiner*—Ren Yan
*Assistant Examiner*—David Banh
(74) *Attorney, Agent, or Firm*—Birch, Stewart, Kolasch & Birch, LLP

(57) ABSTRACT

A printing module provided with a frame (12), an impression roller (13), a plate cylinder assembly (22), an anilox roller and a doctor roller, wherein the printing module comprises two receiving units disposed on opposite sides of the plate cylinder, which are connected with the frame, while fixation means are provided for fixating the plate cylinder assembly in the receiving units, the fixation means (26, 27) being situated substantially under the plate cylinder assembly (22), the fixation means preferably comprising two rods (46,46') which, at an upwardly directed end, are provided with a hook (47,47'), the two hooks, on opposite sides of the plate cylinder, engaging a stationary shaft of the plate cylinder assembly, while on the rods a pull force is exerted for pressing the plate cylinder assembly into the receiving units.

12 Claims, 9 Drawing Sheets

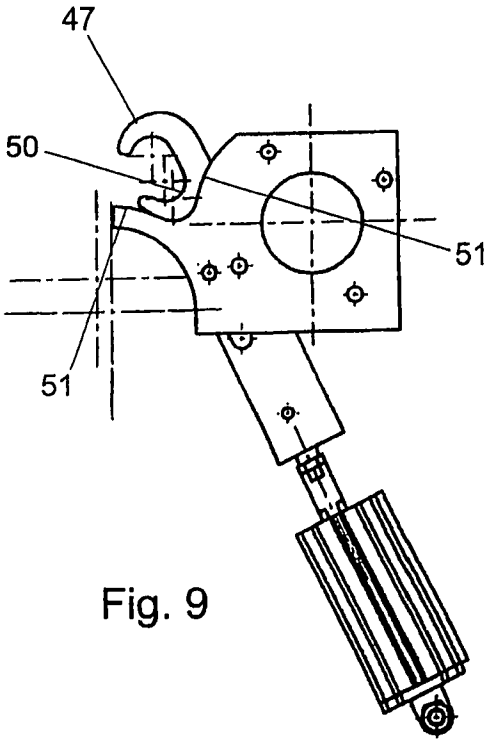
Fig. 9
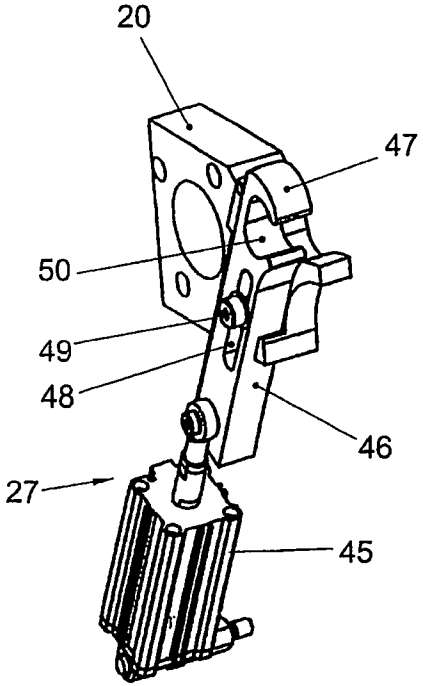
Fig. 8
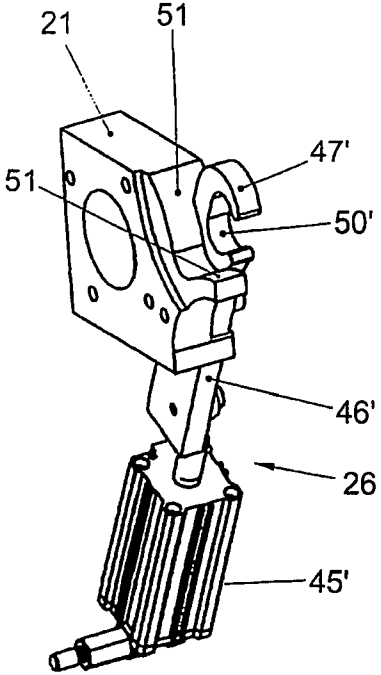

PRINTING MODULE, AND PRINTING MACHINE PROVIDED WITH SUCH PRINTING MODULE

This invention relates to a printing module provided with a frame, an impression roller, a plate cylinder assembly comprising a plate cylinder which is provided with a print image and which, in use, with interposition of a substrate to be printed, abuts against the impression roller, an anilox roller and a doctor roller, the doctor roller taking up ink from an ink reservoir, the anilox roller being arranged between the doctor roller and the plate cylinder, such that a desired amount of ink is taken off the doctor roller by the anilox roller and transferred to the plate cylinder, the plate cylinder assembly being provided with a stationary shaft on which the plate cylinder is rotatably bearing-mounted, while on opposite sides of the plate cylinder a support is fixedly connected with the stationary shaft, the printing module comprising two receiving units disposed on opposite sides of the plate cylinder, which are connected with the frame, in which receiving units rest the supports when the plate cylinder assembly in the operative position is mounted in the printing module, while fixation means are provided for fixating the plate cylinder assembly in the receiving units.

Such an apparatus is known from U.S. Pat. No. 4,878,427, the content of which is to be considered inserted herein. This known apparatus involves a single frame in which the doctor roller, the anilox roller and the impression roller are rotatably bearing-mounted. The relative positions of these three rollers are therefore fixed in the known apparatus. The plate cylinder assembly of the known apparatus is provided, at the free ends thereof, with supports in the form of supporting rings each resting on two semicircular supports which are connected with the frame. In the known apparatus, these semicircular supports constitute the receiving units. The positions of the four semicircular supports are settable. In the known apparatus, fixation means are situated above the plate cylinder assembly. The fixation means comprise two piston-cylinder assemblies which are mounted on a bridge which extends above the plate cylinder assembly. Pusher pins energized by the piston-cylinder assemblies press the supports of the plate cylinder assembly from the top down onto the semicircular supports. A drawback of this construction of the fixation means is that the space above the plate cylinder assembly is already being utilized and therefore cannot be used for other purposes. However, in practice, it is often desirable to pass the substrate web out of a printing module to cause it to undergo a different processing operation. For reasons of space, it would then be particularly favorable if these operations could take place above a printing module. To that end, it must then be possible for the substrate web to be diverted in upward direction out of the printing module. In the known apparatus, this is not possible. Moreover, the piston-cylinder assemblies and bridge disposed above the plate cylinder assembly make it more difficult to take the plate cylinder assembly out of the printing module.

The invention contemplates a printing module which allows the substrate web to be diverted in upward direction out of the printing module. In addition, a printing module is contemplated, of which the plate cylinder assembly is well accessible in that the space above the plate cylinder assembly is not occupied, or hardly so, by other machine parts.

To that end, the printing module of the type described in the opening paragraph hereof is characterized in that the fixation means are situated substantially under the plate cylinder assembly.

Due to the fixation means being situated substantially under the plate cylinder assembly, the space above the plate cylinder assembly is freely accessible. As a consequence, this space is available for diverting the substrate web through it in upward direction to another processing station. Moreover, the free space is convenient for the purpose of ready exchange of a plate cylinder assembly.

According to a practical further elaboration of the invention, the fixation means comprise two rods which, at an upwardly directed end, are provided with a hook, the two hooks, on opposite sides of the plate cylinder, engaging the stationary shaft of the plate cylinder assembly when the plate cylinder assembly is in the operative position, while on the rods a pull force is exerted for pressing the plate cylinder assembly into the receiving units.

With such hooks, a stable locking of the plate cylinder assembly in the receiving units is effected.

According to a further elaboration of the invention, the two rods may each be connected, at the ends remote from the hooks, with a piston-cylinder assembly for adjusting the position of the rods in a longitudinal direction thereof and for exerting the pull force referred to.

According to another further elaboration of the invention, the fixation means are further provided with bearing surfaces on which rests the plate cylinder assembly when the fixation means are in a release position, while the plate cylinder assembly in this release position is lifted out of the receiving units and is moved upwards, such that the plate cylinder assembly can be simply taken out of the printing module. The plate cylinder assembly is essentially being presented, so that the operator can take it out particularly simply.

According to a still further elaboration of the invention, substantially above the receiving units, receiving means are provided for mounting additional processing means.

The substrate web can be passed to these additional processing means. Additional processing means may be understood to include, for instance, substrate web inverters, winders, unwinders, digital printheads, punching units, laminating or delaminating units or the like.

The invention further relates to a printing machine provided with at least one printing module according to the invention.

Further elaborations of the invention are described in the subclaims and will be further clarified hereinafter on the basis of an exemplary embodiment, with reference to the drawings.

FIG. 8 shows a similar perspective view to FIG. 6, without the plate cylinder assembly;

FIG. 9 shows a similar side elevation to FIG. 7, without the plate cylinder assembly;

Figure 1:
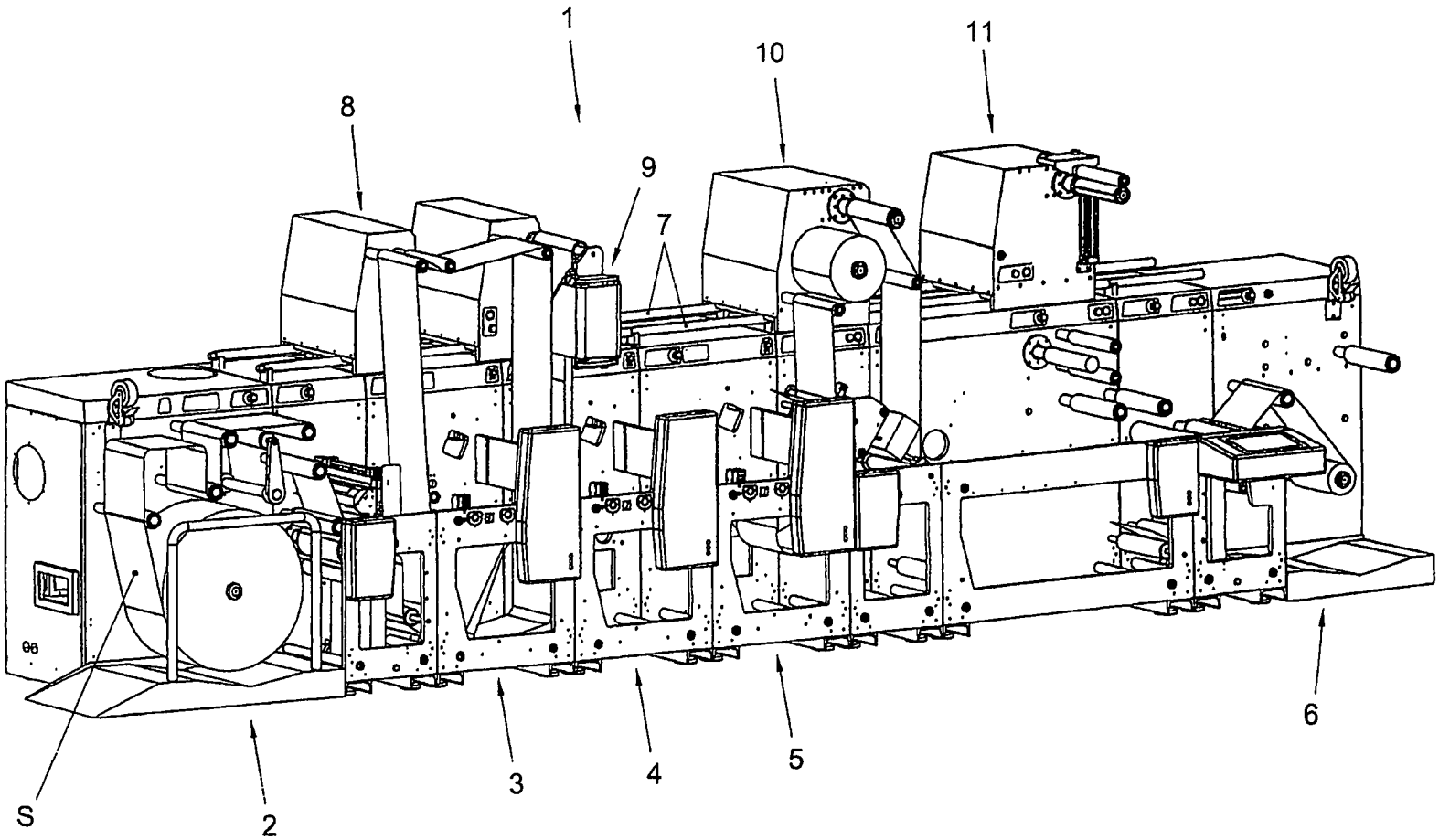
FIG. 1 shows a perspective view of a printing machine provided with a number of printing modules.

The exemplary embodiment of a printing machine 1 represented in FIG. 1 is provided with an unwinding unit 2, a number of printing modules 3-5, and a winding unit 6. Arranged on the upper side of the printing modules are rails 7 on which additional processing stations can be mounted. Depending on the desired end result, the additional processing stations can be placed at different positions on the rails 7. By way of example, the drawing shows a delaminating and relaminating unit 8 for temporarily splitting a self-adhesive substrate web from a carrier material web. Further, a web inverting unit 9 is shown, with which the substrate web S can be inverted, for instance for the purpose of printing the other side thereof. Further, a laminating unwinding and winding unit 10 is shown, for the purpose of applying a laminate to the substrate web S, such as for instance hot foil or cold foil. Finally, a matrix winder is provided for winding up waste material after, for instance, labels have been punched out of the substrate web S, FIG. 1 shows the printing modules 3-5 without the ink application means, the plate cylinder and the impression roller.

Figure 2:
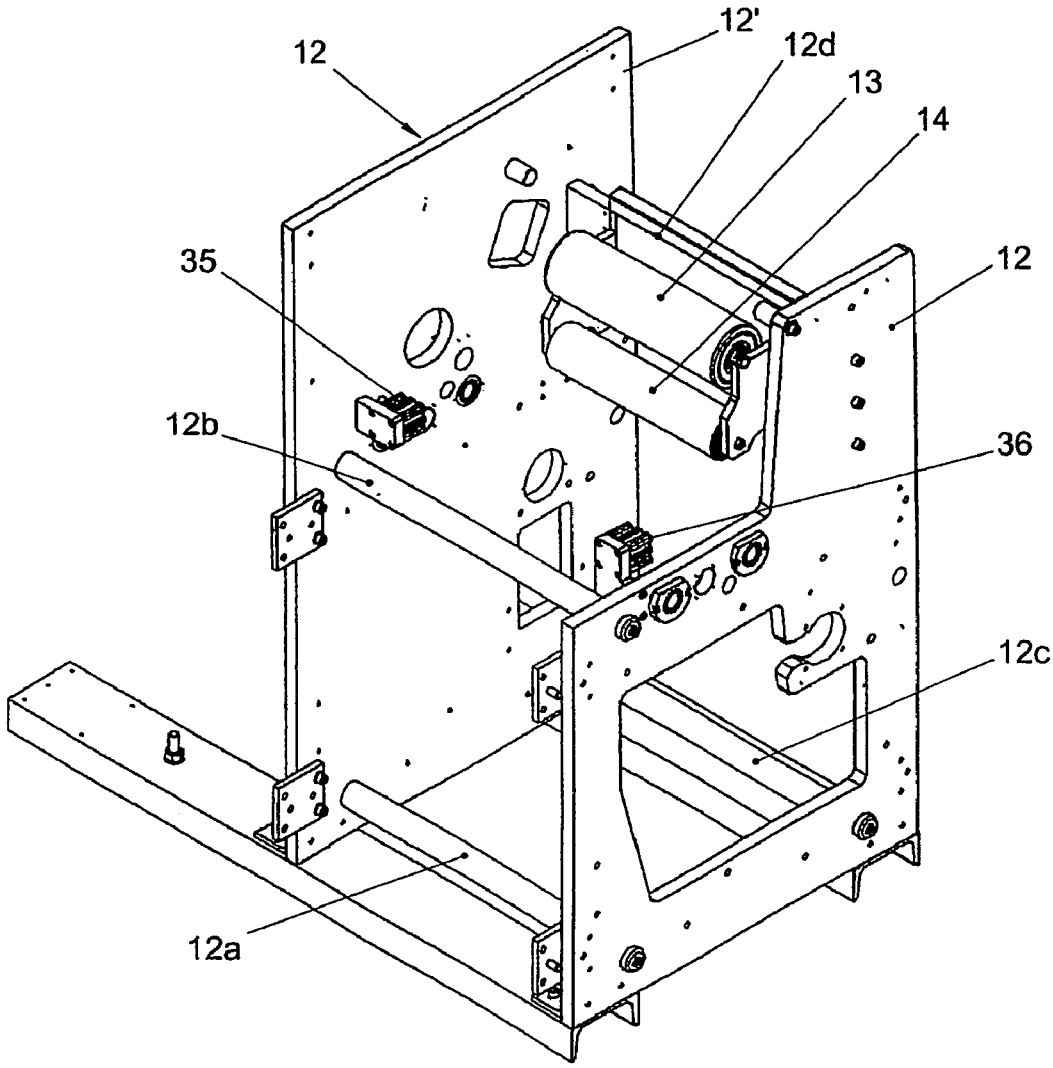
FIG. 2 shows a perspective view of a main frame of the printing module, with the impression roller and a guide roller mounted in the main frame.

FIG. 2 shows the main frame 12 of a printing module 3-5. The main frame comprises two main frame plates 12, 12', which are mutually connected by a number of rods 12*a*, 12*b*, 12*c* and a connecting plate 12*d*. In the main frame 12, an impression roller 13 is rotatably bearing-mounted. Further, a guide roller 14 is shown, which is also bearing-mounted rotatably in the main frame 12.

Figure 3:
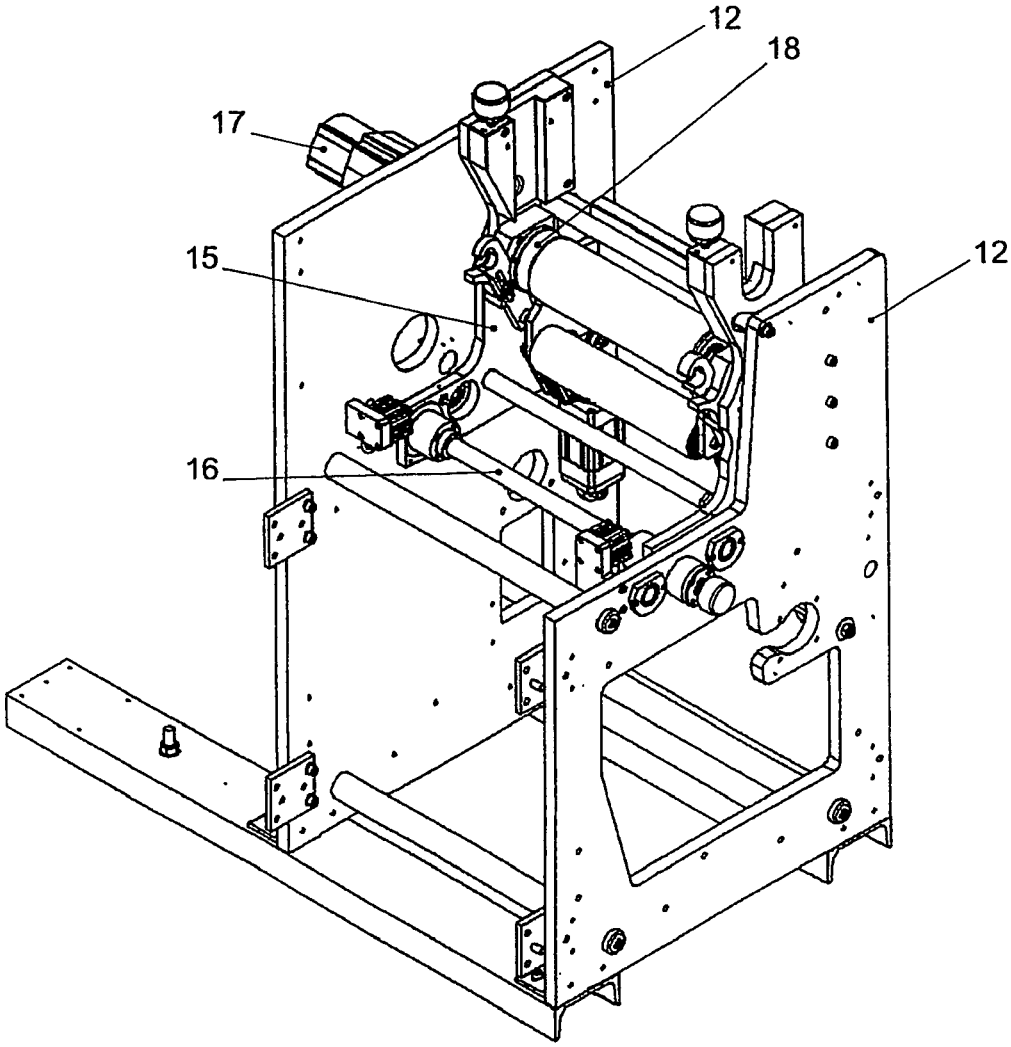
FIG. 3 shows a similar perspective view to FIG. 2, with a first subframe mounted pivotably in the main frame.
Figure 4:
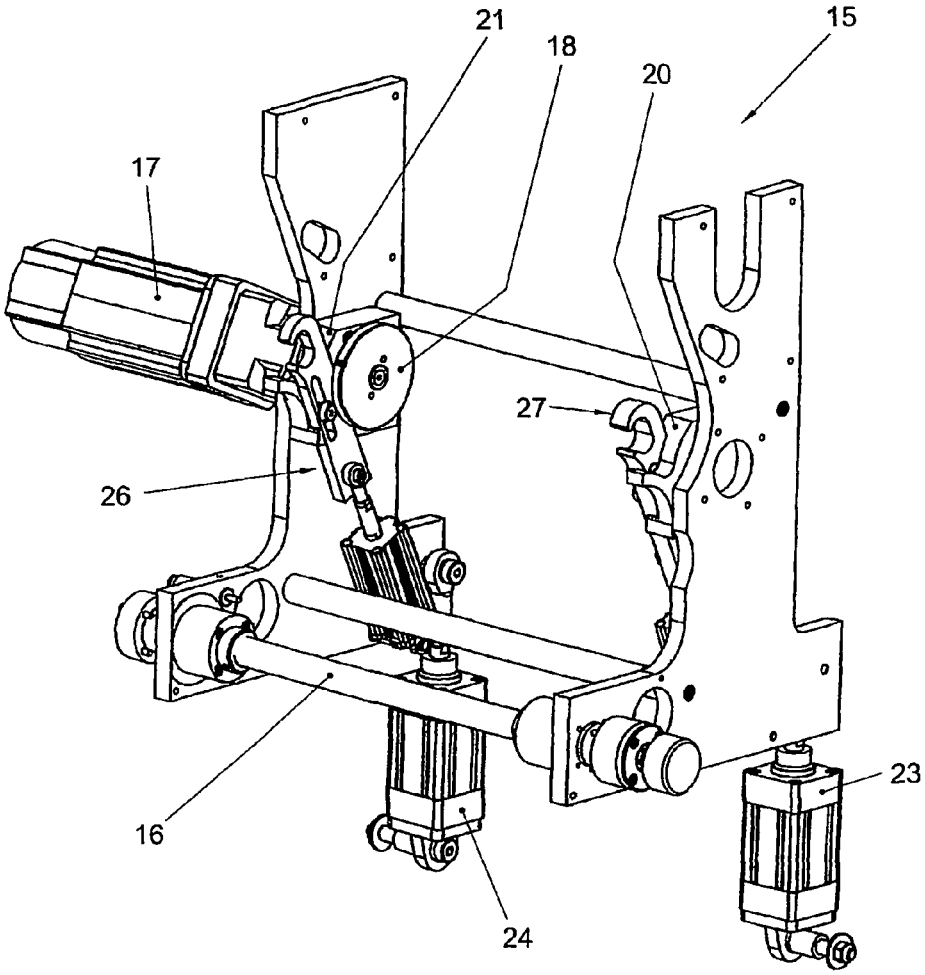
FIG. 4 shows a perspective view of the first subframe separately from the main frame.

FIG. 3 shows the printing module in a condition when it is built up somewhat further. In the main frame 12, presently, a first subframe 15 is included pivotably about pivot 16. For the sake of clarity, FIG. 4 shows the first subframe 15 separately. In FIG. 4 it is clearly visible that the first subframe carries a motor 17 which drives a gearwheel 18. Further, receiving units 20, 21 are fixedly connected with the first subframe 15, in which a plate cylinder assembly 22 (see FIG. 5) is receivable. Also, on the first subframe 15, fixation means 26, 27 are mounted, by means of which the plate cylinder assembly 22 can be fixed in the receiving units 20, 21. In FIG. 3 it is clearly visible that above the receiving units 20, 21 the space is empty, so that a plate cylinder assembly 22 to be placed in the receiving units 20, 21 is freely accessible from the top. To be able to utilize this freely accessible space usefully, above the receiving units 20, 21, receiving means (not shown) are provided for mounting additional processing means. The receiving means comprise, in the present exemplary embodiment, two guides (not shown). The additional processing means can comprise, for instance, substrate web inverting units, winders, unwinders, digital printheads, punching units, laminating or delaminating units or the like.

Figure 5:
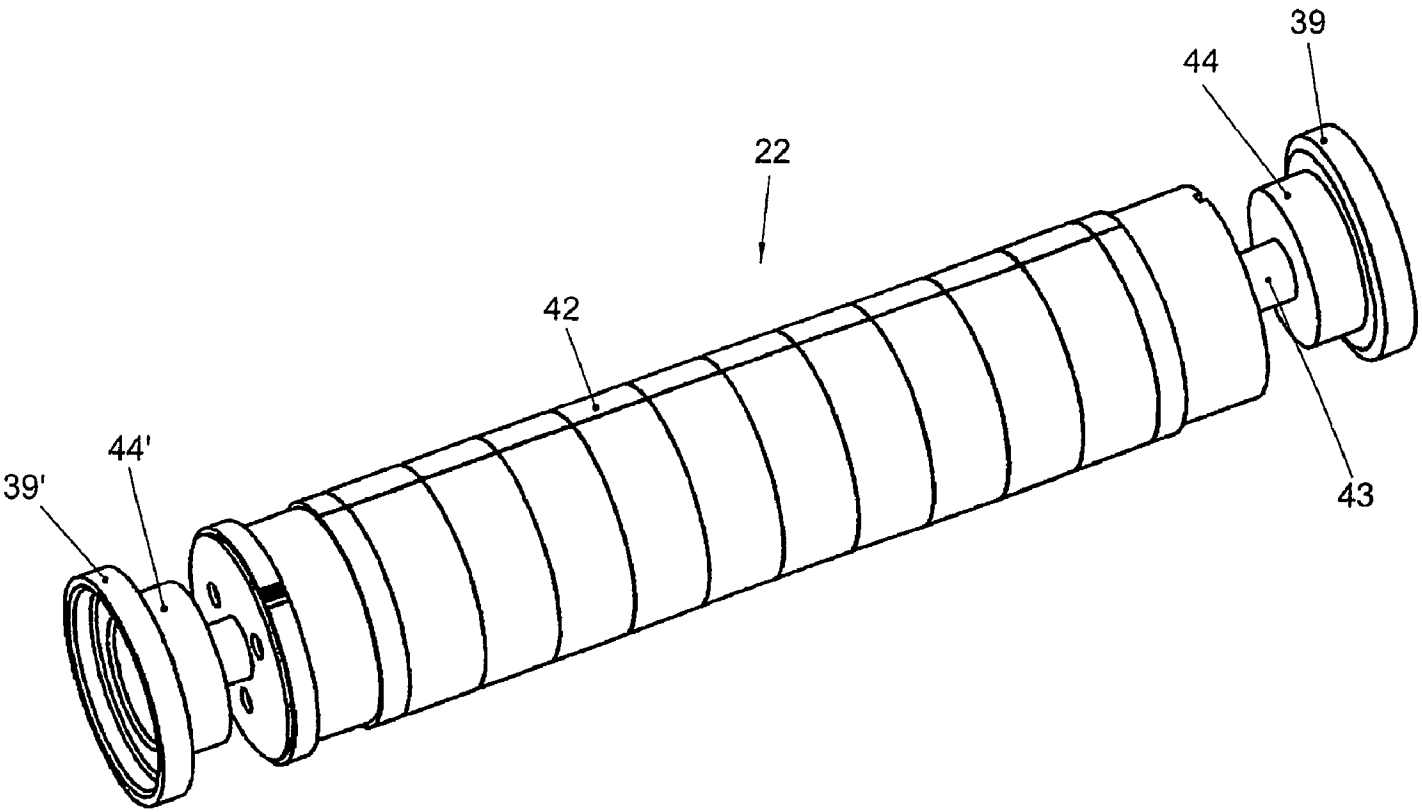
FIG. 5 shows a perspective view of the plate cylinder assembly.
Figure 7:
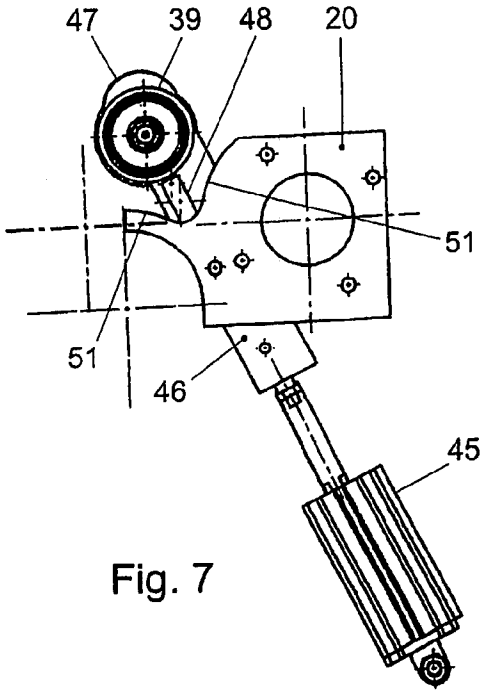
FIG. 7 shows a side elevation of fixation means with the receiving units and the plate cylinder assembly in a take-out position.
Figure 6:
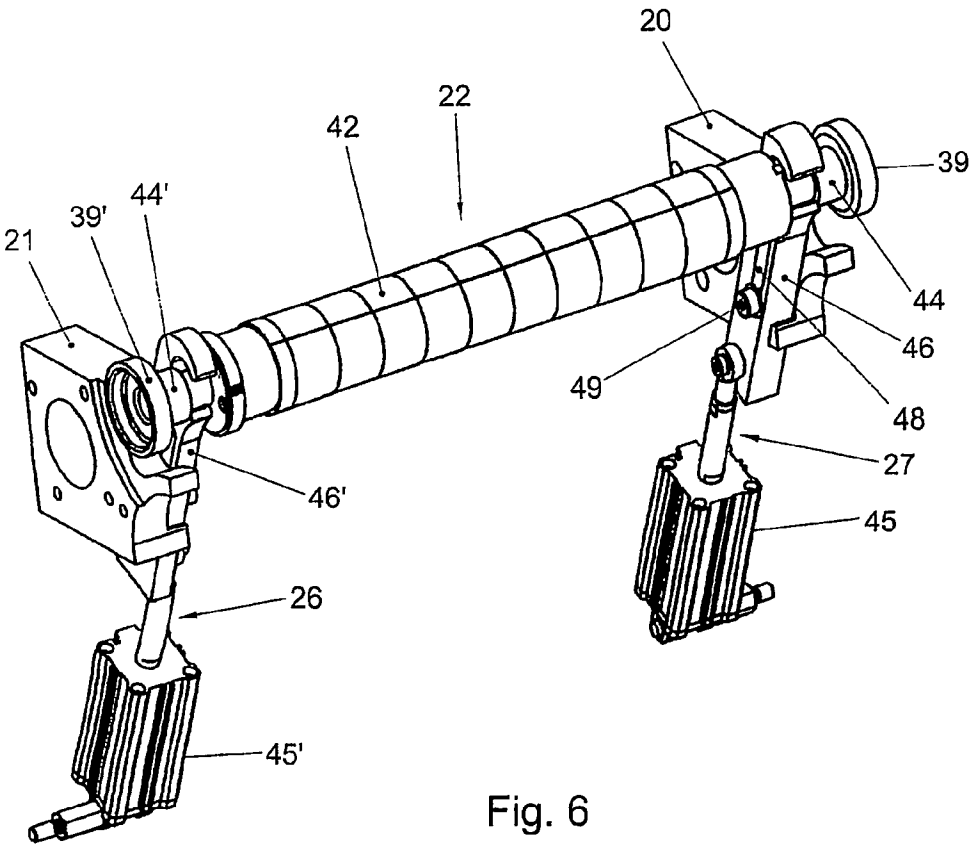
FIG. 6 shows a perspective view of the fixation means with the receiving units, with the plate cylinder assembly in a take-out position.
Figure 11:
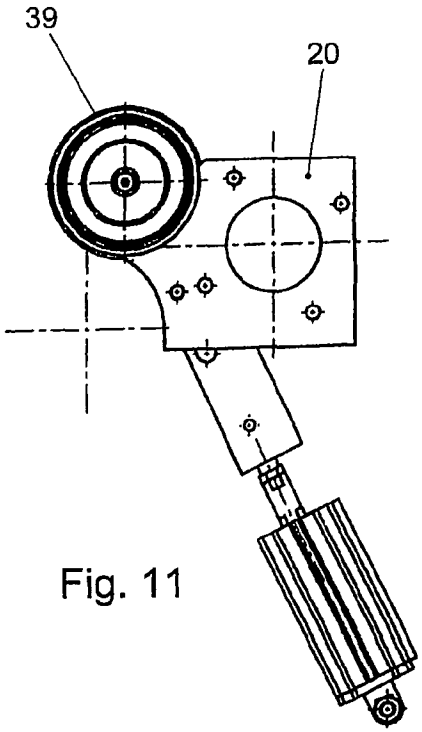
FIG. 11 shows a similar side elevation to FIG. 7, with the plate cylinder assembly in the operative position.
Figure 10:
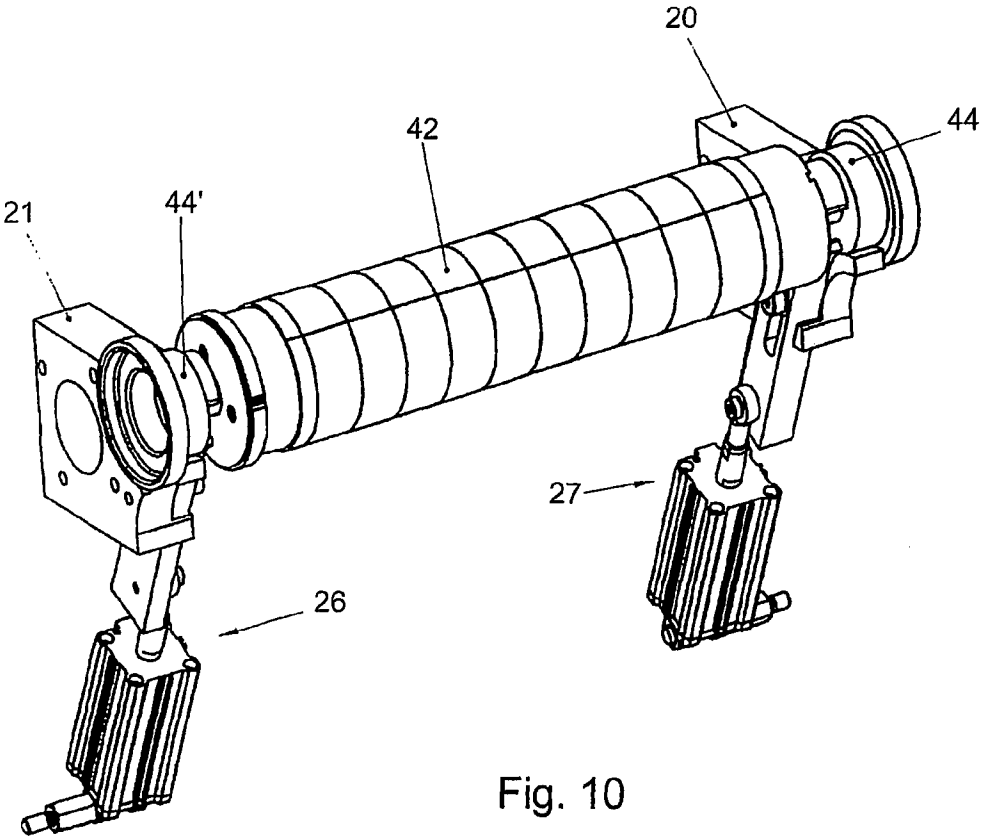
FIG. 10 shows a similar perspective view to FIG. 6, with the plate cylinder assembly in the operative position.

FIG. 5 shows, in perspective, an exemplary embodiment of a plate cylinder assembly 22. The plate cylinder assembly 22 is provided with a plate cylinder 42 which is rotatable about a stationary shaft 43. Mounted on the stationary shaft 43 are supports 44, 44' in the form of supporting rings 44, 44' which are received in the receiving units 20, 21. Instead of supporting rings, differently shaped supports, as of triangular, rectangular or like design, can be used.

To clarify how the plate cylinder assembly 22 is retained in the receiving units 20, 21, reference is made to FIGS. 6-12. In these figures, in each case, the receiving units 20, 21, fixation means 26, 27 and possibly a plate cylinder assembly 22 are shown. The fixation means 26, 27 are situated substantially under the receiving units 20, 21 and the plate cylinder assembly 22, so that the space above the plate cylinder assembly 22 is freely accessible. The fixation means 26, 27 each comprise a piston-cylinder assembly 45, 45', which operates a rod 46, 46', which rod 46, 46' has a longitudinal centerline in the direction of which the rod 46, 46' is movable by the respective piston-cylinder assembly 45, 45'. In the present exemplary embodiment, to that end, the rods 46, 46' are provided with a guide slot 48, in which extends a guide lug 49 which is fixedly connected with the main frame 12. An upwardly directed end of each rod 46, 46' is provided with a hook 47, 47'. The two hooks 47, 47' engage, on opposite sides of the plate cylinder 42, the stationary shaft 43 of the plate cylinder assembly 22 when the plate cylinder assembly 22 is in the operative position. In the operative condition, the piston-cylinder assemblies 45, 45' exert a pull force on the rods 46, 46', for pressing the plate cylinder assembly 22 into the receiving units 20, 21.

As is clearly visible in FIGS. 8 and 9, the rods 46, 46' are provided with bearing surfaces 50, 50' on which rests the plate cylinder assembly 22 when the fixation means 26, 27 are in a release position. The plate cylinder assembly 22 in this release position is lifted out of the receiving units 20, 21 and moved upwards, such that the plate cylinder assembly 22 can be simply taken out of the printing module 3-5. Each bearing surface 50, 50' upon upward movement of the rods 46, 46' in the direction of the longitudinal centerlines of the rods automatically enters into engagement with the stationary shaft 43 and thereby lifts the plate cylinder assembly 22 out of the receiving units 20, 21.

Figure 12:
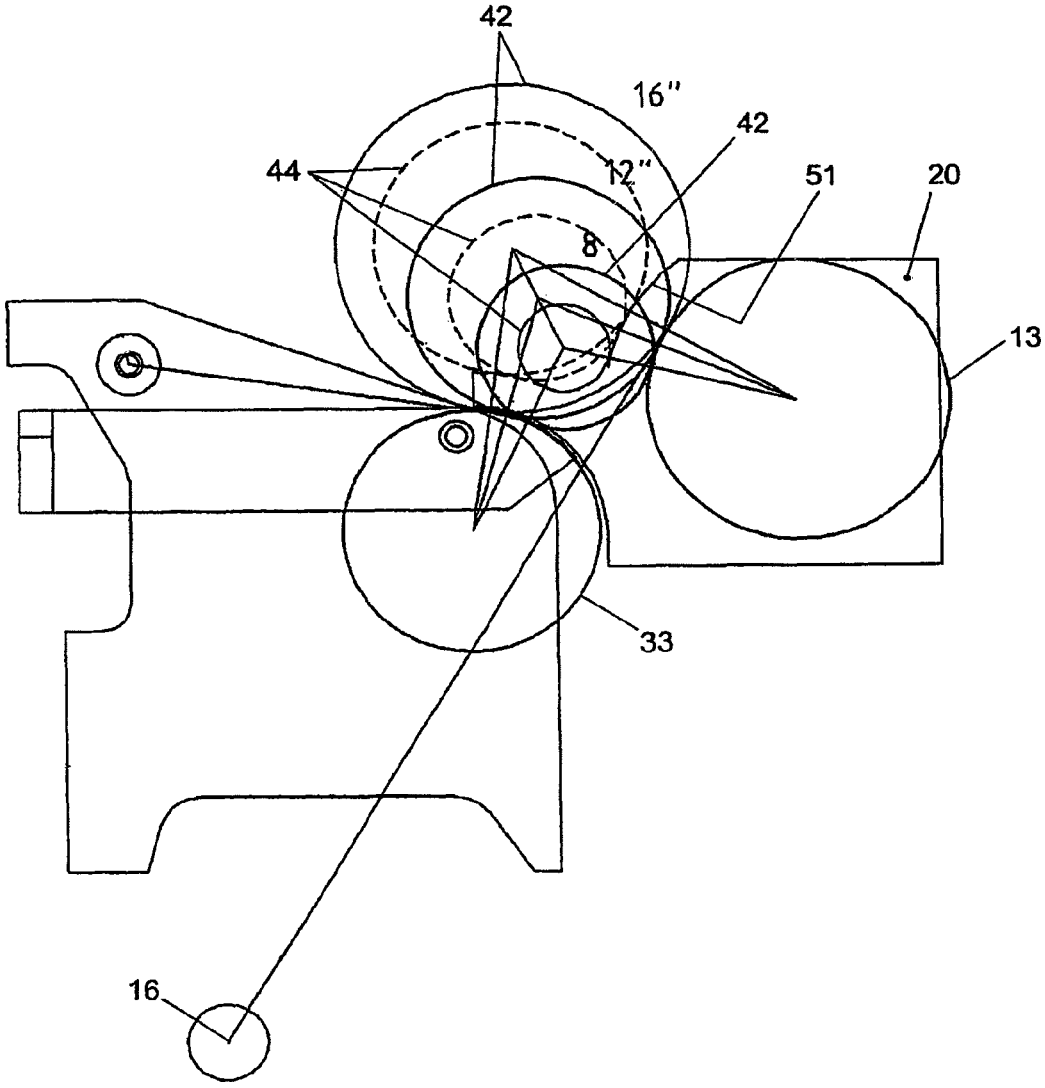
FIG. 12 shows, in diagrammatic side view, the receiving units, the impression roller, the second subframe with the anilox roller and three plate cylinder assemblies of different diameters.

The receiving units 20, 21 are each provided with a supporting surface 51, 51', which is provided with a particular curve. The curve is such that the distance between plate cylinder 42 and the anilox roller 33 on the one hand and the distance between the plate cylinder 42 and the impression roller 13 on the other in each case remain, in pairs, mutually equal at different diameters of plate cylinders 42, which are provided with supports 44, 44' having diameters matching the plate cylinders 42. In FIG. 12 it is clearly visible what is meant by this. The effect of such a construction of the receiving units 20, 21 and circular supporting rings 44, 44' is that when changing the plate cylinder diameter the distance between the anilox roller 33 and the plate cylinder 44 and the distance between the impression roller 13 and the plate cylinder 42 do not need to be set anew. This yields a considerable saving on the setting time.

It will be clear that the invention is not limited to the exemplary embodiment described but that various modifications are possible within the scope of the invention as defined by the claims.

The invention claimed is:

1. A printing module provided with a frame, an impression roller, a plate cylinder assembly comprising a plate cylinder which is provided with a print image and which, in use, with interposition of a substrate to be printed, abuts against the impression roller, and an anilox roller arranged adjacent to the plate cylinder, such that a desired amount of ink is transferred by the anilox roller to the plate cylinder, the plate cylinder assembly being provided with a stationary shaft on which the plate cylinder is rotatably bearing-mounted, while on opposite sides of the plate cylinder a support is fixedly connected with the stationary shaft, the printing module comprising two receiving units disposed on opposite sides of the plate cylinder, which are connected with the frame, in which receiving units rest the supports when the plate cylinder assembly in the operative position is mounted in the printing module, while fixation means are provided for fixating the plate cylinder assembly in the receiving units, wherein the fixation means are situated substantially under the plate cylinder assembly, wherein the fixation means comprise two rods which, at an upwardly directed end, are provided with a hook, the two hooks, on opposite sides of the plate cylinder, engaging the stationary shaft of the plate cylinder assembly when the plate cylinder assembly is in the operative position, and wherein the engaged hooks are oriented to exert a downward force on the stationary shaft for pressing the plate cylinder assembly into the receiving units.

2. The printing module according to claim 1, wherein the two rods are each connected, at the ends remote from the hooks, with a piston-cylinder assembly for adjusting the position of the rods in a longitudinal direction thereof and for exerting said pull force.

3. The printing module according to any one of claims 1-2, wherein the fixation means are further provided with bearing surfaces on which rests the plate cylinder assembly when the fixation means are in a release position, while the plate cylinder assembly in this release position is lifted out of the receiving units and is moved upwards, such that the plate cylinder assembly can be simply taken out of the printing module.

4. The printing module according to claim 1, wherein each rod is provided with a bearing surface, which bearing surface upon upward movement of the rods in the direction of the longitudinal axes of the rods automatically enters into engagement with the stationary shaft and thereby lifts the plate cylinder assembly from the receiving units.

5. The printing module according to claim 1, wherein the supports that are fixedly connected with the stationary shaft on opposite sides of the plate cylinder are supporting rings each having a diameter that matches the diameter of the plate cylinder, the receiving units each being provided with a supporting surface which is provided with a particular curve, the curve being such that the distance between plate cylinder and the anilox roller on the one hand and the distance between the plate cylinder and the impression roller on the other in each case remain, in pairs, mutually equal at different diameters of plate cylinders, which are provided with rings of diameters matching the plate cylinders.

6. The printing module according to claim 1, wherein substantially above the receiving units, receiving devices are provided for mounting additional processing means.

7. The printing module according to claim 6, wherein the receiving devices comprise two guides.

8. The printing module according to claim 6 wherein the additional processing means comprise substrate web inverting units, winders, unwinders, digital printheads, punching units, laminating or delaminating units.

9. A printing machine provided with at least one printing module provided with a frame, an impression roller, a plate cylinder assembly comprising a plate cylinder which is provided with a print image and which, in use, with interposition of a substrate to be printed, abuts against the impression roller, and an anilox roller, the anilox roller being arranged adjacent to the plate cylinder, such that a desired amount of ink is transferred by the anilox roller to the plate cylinder, the plate cylinder assembly being provided with a stationary shaft on which the plate cylinder is rotatably bearing-mounted, while on opposite sides of the plate cylinder a support is fixedly connected with the stationary shaft, the printing module comprising two receiving units disposed on opposite sides of the plate cylinder, which are connected with the frame, in which receiving units rest the supports when the plate cylinder assembly in the operative position is mounted in the printing module, while fixation means are provided for fixating the plate cylinder assembly in the receiving units, wherein the fixation means are situated substantially under the plate cylinder assembly, wherein the fixation means comprise two rods which, at an upwardly directed end, are provided with a hook, the two hooks, on opposite sides of the plate cylinder, engaging the stationary shaft of the plate cylinder assembly when the plate cylinder assembly is in the operative position, and, wherein the engaged hooks are oriented to exert a downward force on the stationary shaft for pressing the plate cylinder assembly into the receiving units when the plate cylinder is in the operative position.

10. The printing module of claim 1, wherein the fixation means are situated substantially under the plate cylinder assembly and not above the top of the plate cylinder to permit free access to the plate cylinder assembly from above the plate cylinder assembly.

11. The printing module according to claim 1, wherein the receiving units are each provided with a supporting surface which is provided with a particular curve, the curve being such that the distance between plate cylinder and the anilox roller on the one hand and the distance between the plate cylinder and the impression roller on the other in each case remain, in pairs, mutually equal for different diameter plate cylinders provided with rings of diameters matching the plate cylinders.

12. The printing module according to claim 1, wherein the plate cylinder assembly is fixed in an operative position without further securing structure.

* * * * *